US009922665B2

(12) United States Patent
Matthews et al.

(10) Patent No.: US 9,922,665 B2
(45) Date of Patent: Mar. 20, 2018

(54) GENERATING A VISUALLY CONSISTENT ALTERNATIVE AUDIO FOR REDUBBING VISUAL SPEECH

(71) Applicant: Disney Enterprises, Inc., Burbank, CA (US)

(72) Inventors: Iain Matthews, Pittsburgh, PA (US); Sarah Taylor, Pittsburgh, PA (US); Barry John Theobald, Norfolk (GB)

(73) Assignee: Disney Enterprises, Inc., Burbank, CA (US)

( * ) Notice: Subject to any disclaimer, the term of this patent is extended or adjusted under 35 U.S.C. 154(b) by 71 days.

(21) Appl. No.: 14/820,410

(22) Filed: Aug. 6, 2015

(65) Prior Publication Data

US 2017/0040017 A1 Feb. 9, 2017

(51) Int. Cl.

| | |
|---|---|
| ***G10L 21/0356*** | (2013.01) |
| ***G10L 21/055*** | (2013.01) |
| ***G10L 25/57*** | (2013.01) |
| ***G10L 21/10*** | (2013.01) |

(52) U.S. Cl.

CPC ..... *G10L 25/57* (2013.01); *G10L 21/10* (2013.01); *G10L 21/055* (2013.01); *G10L 2021/105* (2013.01)

(58) Field of Classification Search

CPC ... G10L 2021/105; G10L 13/08; G10L 15/26; G10L 21/06; G10L 13/00; G10L 13/033; G10L 15/02; G10L 2015/025

USPC ..... 704/1–10, 275, 278, 235, 260, 270, 258; 345/473

See application file for complete search history.

(56) References Cited

U.S. PATENT DOCUMENTS

| | | | | |
|---|---|---|---|---|
| 7,613,613 | B2 * | 11/2009 | Fields | 704/260 |
| 2002/0097380 | A1 * | 7/2002 | Moulton | G03B 31/00 352/5 |
| 2005/0042591 | A1 * | 2/2005 | Bloom | G11B 27/034 434/307 A |
| 2007/0009180 | A1 * | 1/2007 | Huang | G06T 17/20 382/276 |
| 2009/0132371 | A1 * | 5/2009 | Strietzel | G06Q 30/0247 705/14.46 |

(Continued)

OTHER PUBLICATIONS

"Speechreading and the structure of the lexicon: Computationally modeling the effects of reduced phonetic distinctiveness on lexical uniqueness" by Edward T. Auer, Jr. et al., 1997, pp. 1-7.

(Continued)

*Primary Examiner* — Chan S Park
*Assistant Examiner* — Stephen M Brinich
(74) *Attorney, Agent, or Firm* — Farjami & Farjami, LLP

(57) ABSTRACT

There are provided systems and methods for generating a visually consistent alternative audio for redubbing visual speech using a processor configured to sample a dynamic viseme sequence corresponding to a given utterance by a speaker in a video, identify a plurality of phonemes corresponding to the dynamic viseme sequence, construct a graph of the plurality of phonemes that synchronize with a sequence of lip movements of a mouth of the speaker in the dynamic viseme sequence, use the graph to generate an alternative phrase that substantially matches the sequence of lip movements of the mouth of the speaker in the video.

18 Claims, 5 Drawing Sheets

(56) References Cited

U.S. PATENT DOCUMENTS

2015/0199978 A1* 7/2015 McCoy ..... G10L 21/10
704/270

OTHER PUBLICATIONS

"Phoneme Lattice Based A* Search Algorithm for Speech Recognition" by Pascal Nocera et al., 2002, pp. 1-8.
"Visual Phonemic Ambiguity and Speechreading" by Björn Lidestam et al., Aug. 2006, pp. 835-847.
"A SegmentBased AudioVisual Speech Recognizer: Data Collection, Development, and Initial Experiments" by Timothy J. Hazen et al., Oct. 2004, pp. 1-8.
"Dynamic Units of Visual Speech" by Sarah L. Taylor et al., 2012, pp. 1-10.
"Facial animation based on context-dependent visemes" by Jose Mario De Martino et al., 2006, pp. 972-980.
"Objective Viseme Extraction and Audiovisual Uncertainty: Estimation Limits between Auditory and Visual Modes" by Javier Melenchon et al., 2007, pp. 1-4.
"Continuous Optical Automatic Speech Recognition by Lipreading" by Alan J. Godschen et al., 1995, pp. 572-577.
"Visual Vowel and Diphthong perception across Speakers" by Sharon A. Lesner et al., 1981, pp. 252-258.
"Classification of Lip-Shapes and Their Association with Acoustic Speech Events" by N. Michael Brooke et al., Sep. 1990, 245-248.

* cited by examiner

200

210

GENERATING A VISUALLY CONSISTENT ALTERNATIVE AUDIO FOR REDUBBING VISUAL SPEECH

BACKGROUND

Redubbing is the process of replacing the audio track in a video, and has traditionally been used in translating movies and television shows, and in video games for audiences that speak a different language than the original audio recording. Redubbing may also used to replace speech with different audio of the same language, such as redubbing a movie for television broadcast. Conventionally, a replacement audio is meticulously scripted in an attempt to select words that approximate the lip-shapes of actors or animation characters in a video, and a skilled voice actor ensures that the new recording synchronizes well with the original video. The overdubbing process can be time consuming, expensive, and discrepancies between the lip movements of the speaker in the video and the replacement audio may be distracting and appear awkward to viewers.

SUMMARY

The present disclosure is directed to generating a visually consistent alternative audio for redubbing visual speech, substantially as shown in and/or described in connection with at least one of the figures, as set forth more completely in the claims.

DETAILED DESCRIPTION

Figure 1:
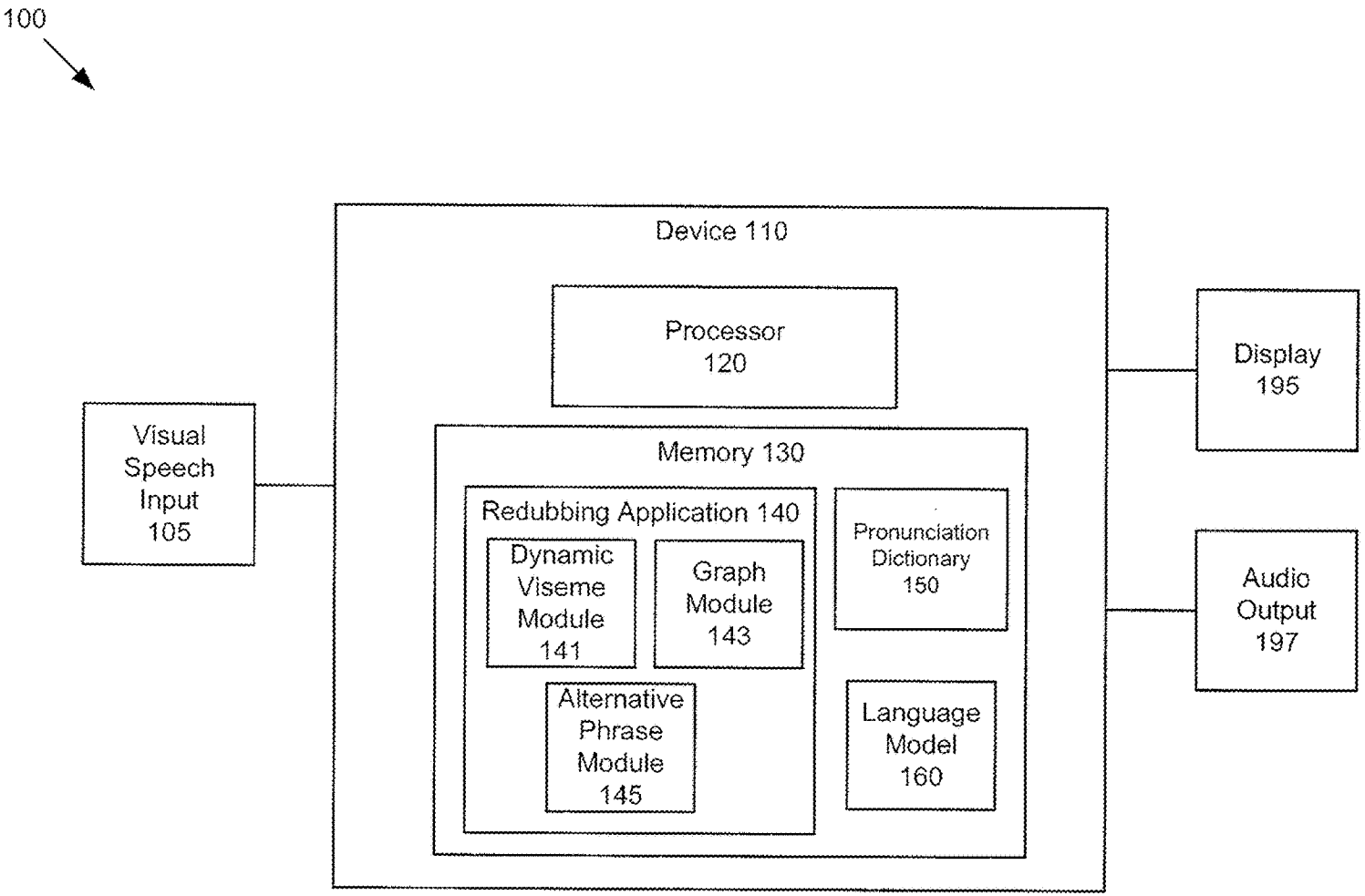
FIG. 1 illustrates an exemplary system for generating visually consistent alternative audio for visual speech redubbing, according to one implementation of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale, and are not intended to correspond to actual relative dimensions.

FIG. 1 illustrates exemplary system 100 for generating visually consistent alternative audio for visual speech redubbing, according to one implementation of the present disclosure. System 100 includes visual speech input 105, device 110, display 195, and audio output 197. Device 110 includes processor 120 and memory 130. Processor 120 is a hardware processor, such as a central processing unit (CPU) used in computing devices. Memory 130 is a non-transitory storage device for storing computer code for execution by processor 120 and also storing various data and parameters. Memory 130 includes redubbing application 140, pronunciation dictionary 150, and language model 160.

Visual speech input 105 includes video input portraying a face of a character speaking. In some implementations, visual speech input 105 may include a video in which the mouth of an actor who is speaking is visible. The mouth of the actor who is speaking may be visible or partially visible in visual speech input 105.

Redubbing application 140 is a computer algorithm for redubbing visual speech, and is stored in memory 130 for execution by processor 120. Redubbing application 140 may generate an alternative phrase that is visually consistent with a visual speech input, such as visual speech input 105. As shown in FIG. 1, redubbing application 140 includes dynamic viseme module 141, graph module 143, and alternative phrase module 145.

Redubbing application 140 may find alternative phrase that is visually consistent with a portion of a video, such as visual speech input 105. Given a viseme sequence, $v=v_1, \ldots, v_n$, redubbing application 140 may produce a set of visually consistent alternative phrase including word sequences, W, where $W_k=w_{(k,1)}, \ldots, w_{(k,m)}$, that, when played back with visual speech input 105, appear to synchronize with the visible articulator motion of the speaker in visual speech input 105. An alternative phrase may include a word, a plurality of words, a part of a sentence, a sentence, or a plurality of sentences. In some implementations, redubbing application 140 may find an alternative phrase in the same language as the video. For example, a television broadcaster may desire to show a movie that includes a phrase that may be offensive to a broadcast audience. The television broadcaster, using redubbing application 140, may find an alternative phrase that the television broadcaster determines to be acceptable for broadcast. Redubbing application 140 may also be used to find an alternative phrase in a language other than the original language of the video.

Dynamic viseme module 141 may be a computer code module within redubbing application 140, and may derive a sequence of dynamic visemes from visual speech input 105. Dynamic visemes are speech movements rather than static poses and they are derived from visual speech independently of the underlying phoneme labels, as described in "Dynamic units of visual speech," *ACM/Eurographics Symposium on Computer Animation* (*SCA*), 2012, pp. 275-284, which is hereby incorporated, in its entirety, by reference. Given a video containing a visible face of a speaker, dynamic viseme module 141 may learn dynamic visemes by tracking the visible articulators of the speaker and parameterizing them into a low-dimensional space. Dynamic viseme module 141 may automatically segment the parameterization by identifying salient points in visual speech input 105 to create a series of short, non-overlapping gestures. The salient points may be visually intuitive and may fall at locations where the articulators change direction, for example, as the lips close during a bilabial, or the peak of the lip opening during a vowel.

Dynamic viseme module 141 may cluster the identified gestures to form dynamic viseme groups, forming viseme classes such that movements that look very similar appear in the same viseme class. Identifying visual speech units in this way may be beneficial, as the set of dynamic visemes describes all of the distinct ways in which the visible articulators move during speech. Additionally, dynamic viseme module 141 may learn dynamic visemes entirely from visual data, and may not include assumptions regarding the relationship to the acoustic phonemes.

In some implementations, dynamic viseme module 141 may learn dynamic visemes from training data including a video of an actor reciting phonetically balanced sentences, captured in full-frontal view at 29.97 fps at 1080p using a camera. In some implementations, the training data may include an actor reciting sentences from the a corpus of phonemically and lexically transcribed speech. The video may capture the visible articulators of the actor, such as the actor's jaw and lips, which may be tracked and parameterized using active appearance models (AAMs) providing a 20D feature vector describing the variation in both shape and appearance at each video frame. In some implementations, the sentences recited in the training data may be annotated manually using the phonetic labels defined in the Arpabet phonetic transcription code. Dynamic viseme module 141 may automatically segment the samples into visual speech gestures and cluster them to form dynamic viseme classes.

Graph module 143 may be a computer code module within redubbing application 140, and may create a graph of dynamic visemes based on the sequence of dynamic visemes in visual speech input 105. In some implementations, graph module 143 may construct a graph that models all valid phoneme paths through the sequence of dynamic visemes. The graph may be a directed acyclic graph. Graph module 143 may add a graph node for every unique phoneme sequence in each dynamic viseme in the sequence, and may then position edges between nodes of consecutive dynamic visemes where a transition is valid, constrained by contextual labels assigned to the boundary phonemes. For example, if contextual labels suggest that the beginning of a phoneme appears at the end of one dynamic viseme, the next should contain the middle or end of the same phoneme, and if the entire phoneme appears, the next gesture should begin from the start of a phoneme. Graph module 143 may calculate the probability of the phoneme string with respect to its dynamic viseme class and may store the probability in each node.

Alternative phrase module 145 may be a computer code module within redubbing application 140, and may produce a plurality of word sequences based on the graph produced by graph module 143. In some implementations, alternative phrase module 145 may search the phoneme graphs for sequences of edge connected nodes that form complete strings of words. For efficient phoneme sequence-to-word lookup a tree-based index may be constructed offline, which allows any phoneme string, $p=p_1, \ldots, p_j$, as a search term and returns all matching words. This may be created using pronunciation dictionary 150. Alternative phrase module 150 may use a left-to-right breadth first search algorithm to evaluate the phoneme graphs. At each node, all word sequences that correspond to all phoneme strings up to that node may be obtained by exhaustively and recursively querying the pronunciation dictionary 150 with phoneme sequences of increasing length up to a specified maximum. The probability of a word sequence may be calculated using:

$$P(w \mid v) = \sum_{i=1}^{m} \log P(w_i \mid w_{i-1}) + \sum_{j=1}^{n} \log P(p \mid v_j) \tag{1}$$

$P(p|v)$ is the probability of phoneme sequence p with respect to the viseme class and $P(w_i|w_{i-1})$ may be calculated using a language model, such as a word bigram, trigram or n-gram model, trained on the Open American National Corpus. To account for data sparsity, the probabilities may be smoothed using known methods, such as Jelinek-Mercer interpolation. The second term in Equation 1 may be constant when evaluating the static viseme-based phoneme graph. A breadth first graph traversal allows for Equation 1 to be computed for every viseme in the sequence and allows for optional thresholding to prune low scoring nodes and increase efficiency. The algorithm also allows partial words to appear at the end of a word sequence when evaluating midsentence nodes. The probability of a partial word is the maximum probability of all words that begins with the phoneme substring, $P(w^p)=\max_{w \in w^p}$, where $w^p$ is the set of words that start with the phoneme sequence $w^p$, $w^p=\{w|w_{(1 \ldots k)}=w^p\}$. If all paths to a node cannot comprise a word sequence, it may be removed from the graph. Complete word sequences may be required when the final nodes are evaluated, which can be ranked on their probability.

Pronunciation dictionary 150 may be used to find possible word sequences that correspond to each phoneme string. Pronunciation dictionary 150 may map from a phoneme sequence to the pronunciation of the phoneme sequence in a target language or a target dialect. In some implementations, pronunciation dictionary 150 may be a pronunciation dictionary such as the CMU Pronouncing Dictionary.

Language model 160 may include a model for a target language. A target language may be a desired language for the replacement audio, and may be the same language as the original language of the video, or may be a language other than the original language of the video. Language model 160 may include a model for a plurality of languages. In some implementations, language model 160 may determine that a string of phonemes may be a valid word in the target language, and that a sequence of words is a valid sentence in the target language. Redubbing application 140 may use the ranked words to identify a string of phonemes as a word, a plurality of words, a phrase, a plurality of phrases, a sentence, or a plurality of sentences in the target language. In some implementations, language model 160 may rank each sequence of phonemes from the graph created by graph module 143, and alternative phrase module 145 may use the ranked sequences of phonemes to construct alternative phrase.

Display 195 may be a display suitable for displaying video content, such as visual speech input 105. In some implementations, display 195 may be a television, a computer monitor, a display of a tablet computer, or a display of a mobile phone. Display 195 may be a light emitting diode (LED) display, an organic light emitting diode (OLED) display, a liquid crystal display (LCD), a plasma display, a cathode ray tube (CRT), an electroluminescent display (ELD), or other display appropriate for viewing video content.

Audio output 197 may be any audio output suitable for playing an audio associated with a video content. Audio output 197 may include a speaker or a plurality of speakers, and may be used to play the alternative phrase with visual speech input 105. In some implementations, audio output 197 may be used to play the alternative phrase synchronized to visual speech input 105, such that the playback of the synchronized audio and video create a visually consistent redubbing of visual speech input 105.

Figure 2A:
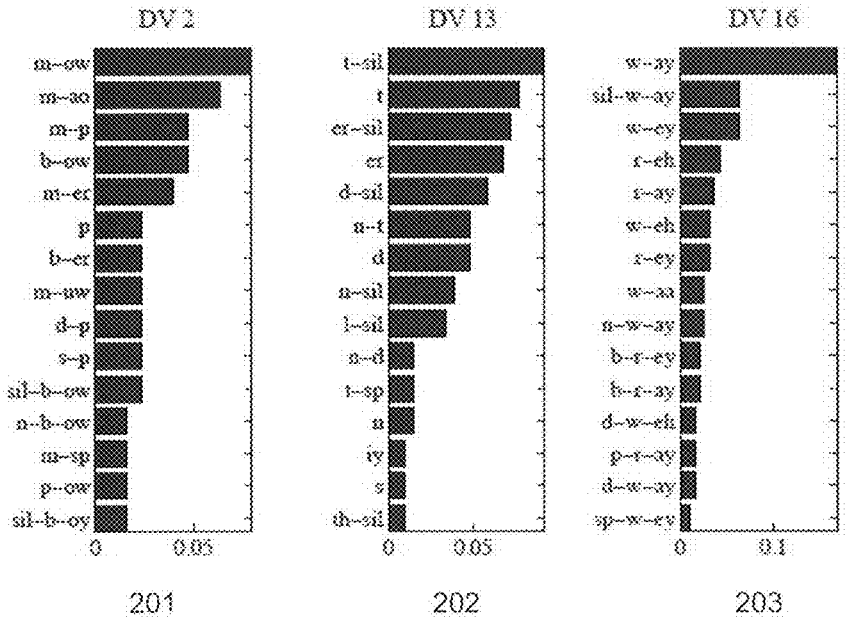
FIG. 2*a* illustrates an exemplary diagram showing a sampling of phoneme string distributions for three dynamic viseme classes and depicting the complex many-to-many mapping between phoneme sequences and dynamic visemes, according to one implementation of the present disclosure.

FIG. 2*a* illustrates exemplary diagram 200 showing a sampling of phoneme string distributions for three dynamic viseme classes and depicting the complex many-to-many mapping between phoneme sequences and dynamic visemes, according to one implementation of the present disclosure. Diagram 200 shows sample distributions for three dynamic viseme classes at 201, 202, and 203. Labels /sil/ and /sp/ respectively denote a silence and short pause. Different gestures that correspond to the same phoneme sequence may be clustered into multiple classes since they may appear distinctive when spoken at variable speaking rates or in different contexts. Conversely, a dynamic viseme class may contain gestures that map to many different phoneme strings. In some implementations, dynamic visemes may provide a probabilistic mapping from speech movements to phoneme sequences (and vice-versa), for example, by evaluating the probability mass distributions.

In some implementations, a dynamic viseme class may represent a cluster of similar visual speech gestures, each corresponding to a phoneme sequence in the training data. Since these gestures may be derived independently of the phoneme segmentation, the visual and acoustic boundaries need not align due to the natural asynchrony between speech sounds and the corresponding facial movements. For better modeling in situations where the boundaries are not aligned, the boundary phonemes may be annotated with contextual labels that signify whether the gesture spans the beginning of the phone ($p_+$), the middle of the phone ($p_*$) or the end of the phone ($p_-$).

Figure 2B:
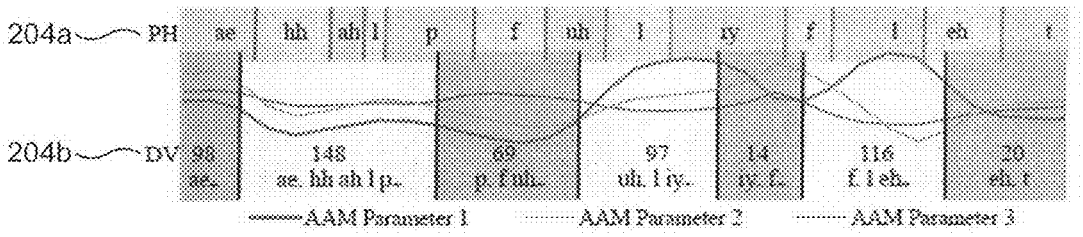
FIG. 2*b* illustrates an exemplary diagram showing phonemes and dynamic visemes corresponding to the phrase "a helpful leaflet," according to one implementation of the present disclosure.

FIG. 2*b* illustrates exemplary diagram 210 showing phonemes and dynamic visemes corresponding to the phrase "a helpful leaflet," according to one implementation of the present disclosure. Diagram 210 shows phonemes 204*a* and dynamic visemes 204*b* corresponding to the phrase "a helpful leaflet." It should be noted that phoneme boundaries and dynamic viseme boundaries do not necessarily align, so phonemes that are intersected by dynamic viseme boundaries may be assigned a context label.

Figure 3:
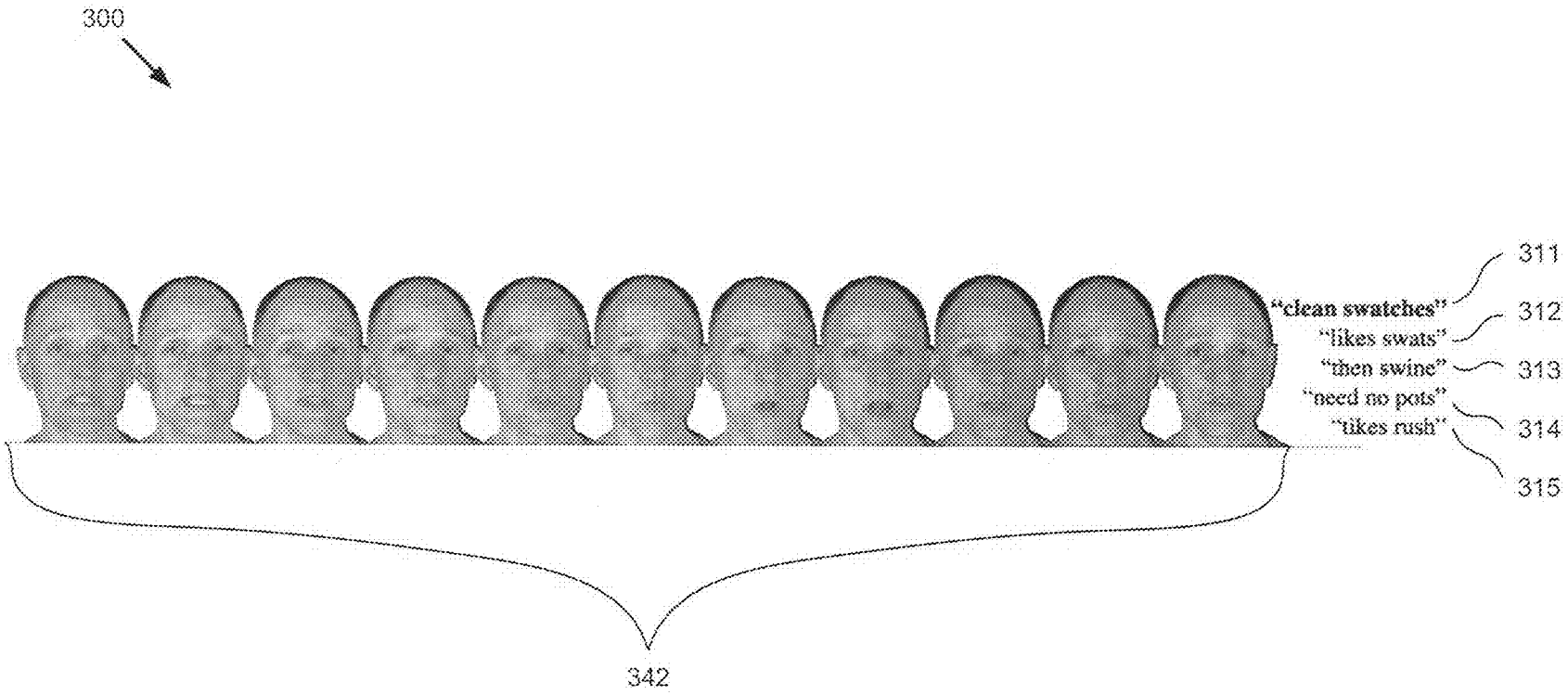
FIG. 3 illustrates a diagram displaying examples of visually consistent speech redubbing, according to one implementation of the present disclosure.

FIG. 3 illustrates exemplary diagram 300 displaying examples of visually consistent speech redubbing, according to one implementation of the present disclosure. Diagram 300 shows a video frames 342 corresponding to a speaker pronouncing the original phrase 311 clean swatches. Alternative phrase "likes swats" 312, "then swine" 313, "need no pots" 314, and "tikes rush" 315 are exemplary alternative phrase that are visually consistent with video frames 342. In some implementations, various alternative phrase may more closely match the sequence of lip movements of the speaker in the video.

Figure 4:
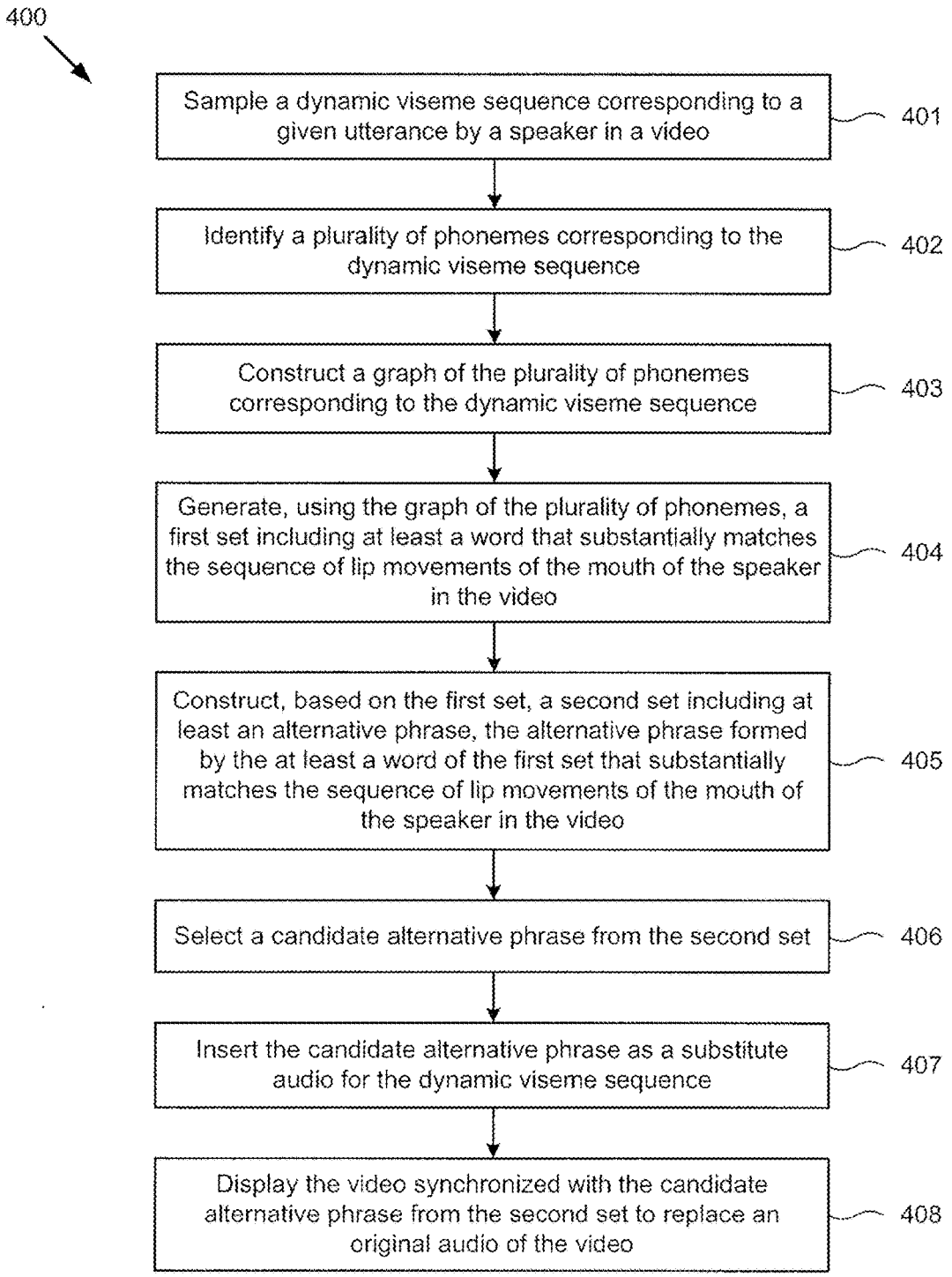
FIG. 4 illustrates an exemplary flowchart of a method of visually consistent speech redubbing, according to one implementation of the present disclosure.

FIG. 4 illustrates exemplary flowchart 400 of a method of visually consistent speech redubbing according to one implementation of the present disclosure. At 401, redubbing application 140 samples a dynamic viseme sequence corresponding to a given utterance by a speaker in a video. The dynamic viseme sequence may correspond to a portion of the video or to the whole video. The sample may capture the face of a speaker and include the mouth of the speaker to capture the articulator motion associated with spoken words. This visual speech may be sampled into a sequence of non-overlapping gestures, where the non-overlapping gestures correspond to visemes. Visemes may be speech movements derived from visual speech.

At 402, redubbing application 140 identifies a plurality of phonemes corresponding to the sampled dynamic viseme sequence. In some implementations, redubbing application 140 may take advantage of the many-to-many mapping between phoneme sequences and dynamic viseme sequences. Redubbing application 140 may generate every phoneme that corresponds to each viseme of the sampled dynamic viseme sequence.

At 403, redubbing application 140 constructs a graph of the plurality of phonemes corresponding to the dynamic viseme sequence. Graph module 143 may construct a graph of all valid phoneme paths through the dynamic viseme sequence by adding a graph node for every unique phoneme sequence in each dynamic viseme in the dynamic viseme sequence. Graph module 143 may then position edges between nodes of consecutive dynamic visemes where a transition is valid. In some implementations, graph module 143 includes weighted edges between nodes that have a valid transition. Graph module 143, in conjunction with language model 160 and pronunciation dictionary 150, may position edges between nodes in the graph such that paths connecting nodes correspond to phoneme sequences that form words.

At 404, redubbing application 140 generates a first set including at least a word that substantially matches the sequence of lip movements of the mouth of the speaker in the video. The first set may be a compete set including every phoneme that corresponds to the sequence of dynamic visemes that was sampled from the video. In some implementations, redubbing application 140 may generate words in a same language as the video or in a different language than the video.

At 405, redubbing application 140 constructs a second set including at least an alternative phrase, the alternative phrase formed by the at least a word of the first set that substantially matches the sequence of lip movements of the mouth of the speaker in the video. In some implementations, the second set may contain a plurality of alternative phrases, each of which may be a possible alternative phrase generated by alternative phrase module 145. A candidate alternative phrase may be a phrase from the second set generated by alternative phrase module 145.

At 406, redubbing application 140 selects a candidate alternative phrase from the second set. In some implementations, the second set may include a plurality of alternative phrase. Redubbing application 140 may score each alternative phrase of the plurality of alternative phrase of the second set based on how closely each alternative phrase matches the sequence of lip movements of the mouth of the speaker in the video. In some implementations, redubbing application 140 may rank the alternative phrase based on the score. Redubbing application 140 may select a higher ranking alternative phrase, or the highest ranking alternative phrase as the candidate alternative phrase.

At 407, redubbing application 140 inserts the candidate alternative phrase as a substitute audio for the video. In some implementations, device 110 may display the video on a display synchronized with the selected alternative phrase replacing an original audio of the video. At 408, system 100 displays the video synchronized with a candidate alternative phrase from the second set to replace an original audio of the video.

Figure 5:
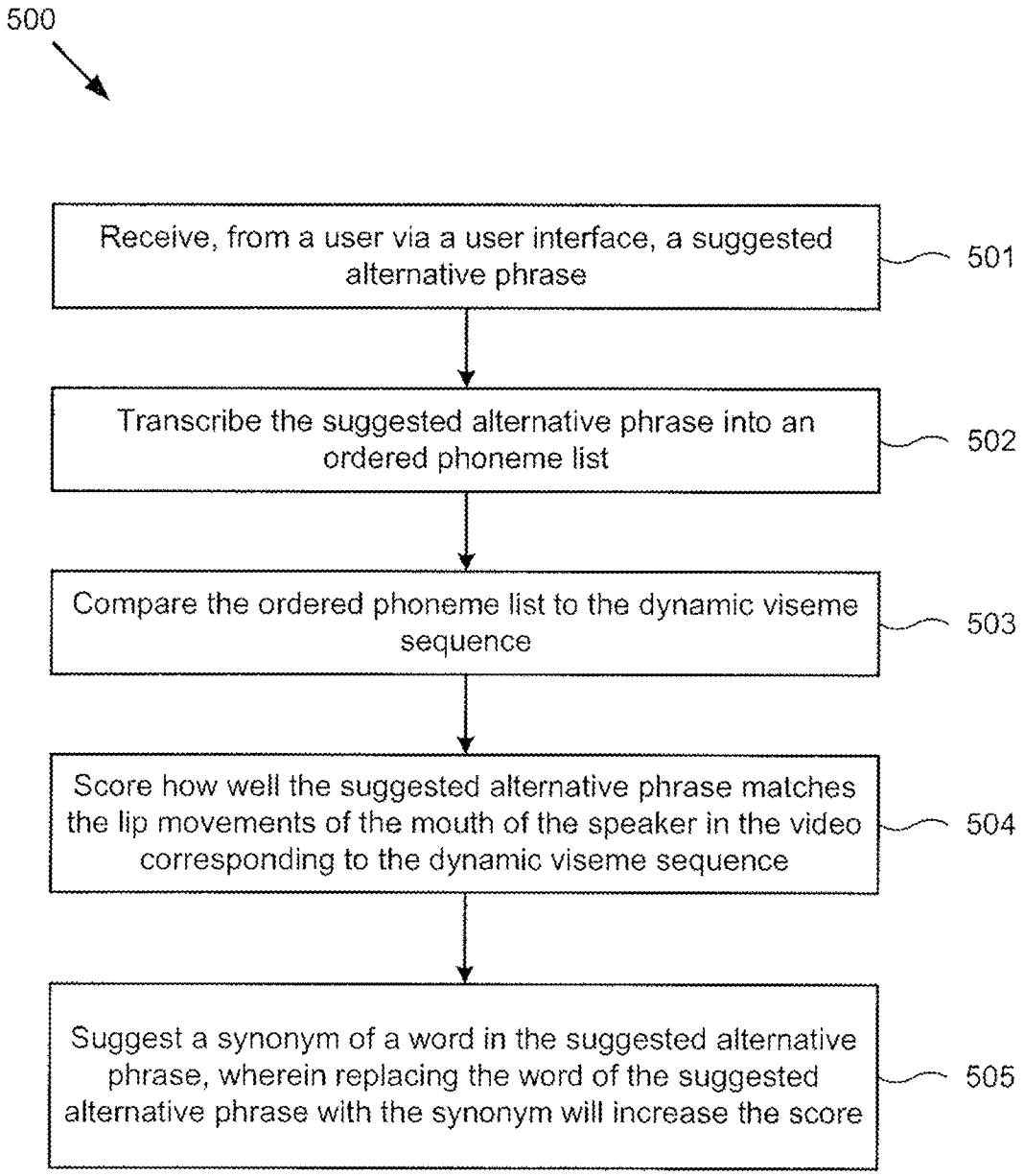
FIG. 5 illustrates an exemplary flowchart of a method of visually consistent speech redubbing, according to one implementation of the present disclosure.

FIG. 5 shows exemplary flowchart 500 of a method of visually consistent speech redubbing according to one implementation of the present disclosure. At 501, redubbing application 140 receives a suggested alternative phrase from a user via a user interface (not shown). At 502, redubbing application 140 transcribes the suggested alternative phrase into an ordered phoneme list. At 503, redubbing application 140 compares the ordered phoneme list to the dynamic viseme sequence. In some implementations, redubbing application 140 may compare the suggested alternative phrase by testing the ordered phoneme sequence against the graph of the phonemes corresponding to the dynamic viseme sequence.

At 504, redubbing application 140 score how well the suggested alternative phrase matches the lip movements of the mouth of the speaker in the video corresponding to the dynamic viseme sequence. A suggested alternative phrase that traverses the graph of the phonemes corresponding to the dynamic viseme sequence may receive a higher score than a suggested alternative phrase that fails to traverse the graph of the phonemes corresponding to the dynamic viseme sequence. A suggested alternative phrase that traverses the graph of the phonemes corresponding to the dynamic viseme sequence may receive a higher score based on how closely the ordered phonemes correspond to the sequence of the lip movements of the speaker in the video. At 505, redubbing application 140 suggests a synonym of a word in the suggested alternative phrase, wherein replacing the word of the suggested alternative phrase with the synonym will increase the score.

From the above description it is manifest that various techniques can be used for implementing the concepts described in the present application without departing from the scope of those concepts. Moreover, while the concepts have been described with specific reference to certain implementations, a person of ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A system for redubbing of a video, the system comprising:

a display;

an audio speaker;

a memory for storing a redubbing application; and a processor configured to execute the reducing application to:

sample a dynamic viseme sequence corresponding to an original phrase uttered by a speaking character having a sequence of original lip movements of a mouth in the video;

identify, using the sampled dynamic viseme sequence, a plurality of phonemes corresponding to the sampled dynamic viseme sequence;

construct a graph of the plurality of phonemes corresponding to the sampled dynamic viseme sequence;

generate, using the graph of the plurality of phonemes, a first set of words including al least one word that substantially matches the sequence of the original lip movements of the mouth of the speaking character in the video;

construct a second set of phrases, using the first set of words, each of the second set of phrases being an alternative phrase to the original phrase;

score each of the second set of phrases based on how closely each of the second set of phrases matches the sequence of lip movements of the mouth of the speaking character in the video;

select, based on the score, one of the second set of phrases as the alternative phrase to the original phrase, the alternative phrase formed by the at least one word of the first set of words substantially matching the sequence of the original lip movements of the mouth of the speaking character in the video; and display the sequence of the original lip movements of the mouth in the video on the display in synchronization with playing the at least one alternative phrase via the audio speaker.

2. The system of claim 1, wherein the first set includes valid words in a target language.

3. The system of claim 1, wherein the second set includes valid sentences in a target language.

4. The system of claim 3, wherein the target language is a different language than an original language of the video.

5. The system of claim 1, wherein the processor is further configured to:

select a candidate alternative phrase from the second set; and insert the candidate alternative phrase as a substitute audio for the sampled dynamic viseme sequence.

6. The system of claim 1, wherein the first set is a complete set including every phoneme that corresponds to the sequence of dynamic visemes.

7. A system for redubbing of a video, the system comprising:

a display;

an audio speaker;

a memory for storing a redubbing application; and a processor configured to execute the reducing application to:

sample a dynamic viseme sequence corresponding to a given utterance by a speaking character in the video;

identify a plurality of phonemes corresponding to the dynamic viseme sequence;

construct a graph of the plurality of phonemes corresponding to the dynamic viseme sequence;

generate, using the graph of the plurality of phonemes, a plurality of words that substantially match a sequence of lip movements of a mouth of the speaking character in the video;

construct a plurality of alternative phrases, each of the plurality of alternative phrases is formed by one or more of the plurality of words substantially matching the sequence of lip movements of the mouth of the speaking character in the video;

score each alternative phrase of the plurality of alternative phrases based on how closely each alternative phrase matches the sequence of lip movements of the mouth of the speaking character in the video;

rank the plurality of alternative phrases based on the score; and display the sequence of lip movements of the mouth in the video on the display in synchronization with playing one of the plurality of alternative phrases via the audio speaker based on ranking.

8. A system for redubbing of a video, the system comprising:

a user interface;

a display;

an audio speaker;

a memory for storing a redubbing application; and a processor configured to execute the reducing application to:

sample a dynamic viseme sequence corresponding to a given utterance by a speaking character in the video;

identify a plurality of phonemes corresponding to the dynamic viseme sequence;

construct a graph of the plurality of phonemes corresponding to the dynamic viseme sequence;

receive, from a user via the user interface, a suggested alternative phrase;

transcribe the suggested alternative phrase into an ordered phoneme list;

compare, using the graph, the ordered phoneme list to the dynamic viseme sequence;

score how well the suggested alternative phrase matches the lip movements of the mouth of the speaking character in the video corresponding to the dynamic viseme sequence; and display the sequence of lip movements of the mouth in the video on the display in synchronization with playing the suggested alternative phrase via the audio speaker based on scoring.

9. The system of claim 8, wherein the processor is further configured to:

suggest a synonym of a word in the alternative phrase, wherein replacing the word in the alternative phrase with the synonym will increase the score.

10. A method for use by a system having a display, an audio speaker, a memory and a processor for redubbing of a video, the method comprising:

sampling, using the processor, a dynamic viseme sequence corresponding to an original phrase uttered by a speaking character having a sequence of original lip movements of a mouth in the video;

identifying, using the processor and the sampled dynamic viseme sequence, a plurality of phonemes corresponding to the sampled dynamic viseme sequence;

constructing, using the processor, a graph of the plurality of phonemes corresponding to the sampled dynamic viseme sequence;

generating, using the processor and the graph of the plurality of phonemes, a first set of words including at least one word that substantially matches the sequence of the original lip movements of the mouth of the speaking character in the video;

constructing, using the processor, a second set of phrases, using the first set of words, each of the second set of phrases being an alternative phrase to the original phrase;

scoring, using the processor, each of the second set of phrases based on how closely each of the second set of phrases matches the sequence of lip movements of the mouth of the speaking character in the video;

selecting, using the processor and based on the score, one of the second set of phrases as the alternative phrase to the original phrase, the alternative phrase formed by the at least one word of the first set of words substantially matching the sequence of the original lip movements of the mouth of the speaking character in the video; and displaying, using the processor, the sequence of the original lip movements of the mouth in the video on the display in synchronization with playing the at least one alternative phrase via the audio speaker.

11. The method of claim 10, wherein the first set includes valid words in a target language.

12. The method of claim 10, wherein the second set includes valid sentences in a target language.

13. The method of claim 12, wherein the target language is a different language than an original language of the video.

14. The method of claim 10, wherein the second set includes a plurality of alternative phrases, the method further comprising:

selecting, using the processor, a candidate alternative phrase from the second set; and inserting, using the processor, the candidate alternative phrase as a substitute audio for the sampled dynamic viseme sequence.

15. The method of claim 10, wherein the first set is a complete set including every phoneme that corresponds to the sequence of dynamic visemes.

16. A method for use by a system having a display, an audio speaker, a memory and a processor for redubbing of a video, the method comprising:

sampling, using the processor, a dynamic viseme sequence corresponding to a given utterance by a speaking character in the video;

identifying, using the processor, a plurality of phonemes corresponding to the dynamic viseme sequence;

constructing, using the processor, a graph of the plurality of phonemes corresponding to the dynamic viseme sequence;

generating, using the processor and the graph of the plurality of phonemes, a plurality of words that substantially match a sequence of lip movements of a mouth of the speaking character in the video;

constructing, using the processor, a plurality of alternative phrases, each of the plurality of alternative phrases is formed by one or more of the plurality of words substantially matching the sequence of lip movements of the mouth of the speaking character in the video;

scoring, using the processor, each alternative phrase of the plurality of alternative phrases based on how closely each alternative phrase matches the sequence of lip movements of the mouth of the speaking character in the video; and ranking, using the processor, the plurality of alternative phrases based on the score;

displaying, using the processor, the sequence of lip movements of the mouth in the video on the display in synchronization with playing one of the plurality of alternative phrases via the audio speaker based on ranking.

17. A method for use by a system having a display, an audio speaker, a memory and a processor for redubbing of a video, the method comprising:

sampling, using the processor, a dynamic viseme sequence corresponding to a given utterance by a speaking character in the video;

identifying, using the processor, a plurality of phonemes corresponding to the dynamic viseme sequence;

constructing, using the processor, a graph of the plurality of phonemes corresponding to the dynamic viseme sequence;

receiving, from a user via the user interface, a suggested alternative phrase;

transcribing, using the processor, the suggested alternative phrase into an ordered phoneme list;

comparing, using the processor and the graph, the ordered phoneme list to the dynamic viseme sequence;

scoring, using the processor, how well the suggested alternative phrase matches the lip movements of the mouth of the speaking character in the video corresponding to the dynamic viseme sequence;

displaying, using the processor, the sequence of lip movements of the mouth in the video on the display in synchronization with playing the suggested alternative phrase via the audio speaker based on scoring.

18. The method of claim 17, further comprising:

suggesting, using the processor, a synonym of a word in the suggested alternative phrase, wherein replacing the word of the suggested alternative phrase with the synonym will increase the score.

* * * * *